US005096392A

United States Patent [19]

Griebel et al.

[11] Patent Number: 5,096,392

[45] Date of Patent: Mar. 17, 1992

[54] APPARATUS FOR CONVEYING PAINTS

[75] Inventors: Heinrich Griebel; Ewald Kille, both of Friedrichshafen; Manfred Kistler, Markdorf, all of Fed. Rep. of Germany

[73] Assignee: J. Wagner GmbH, Fed. Rep. of Germany

[21] Appl. No.: 419,714

[22] Filed: Oct. 11, 1989

[30] Foreign Application Priority Data

Oct. 12, 1988 [DE] Fed. Rep. of Germany ..... 3834657

[51] Int. Cl.[5] ..... F04B 39/14; F04B 49/06

[52] U.S. Cl. ..... 417/454; 417/360; 417/44; 417/413; 417/38

[58] Field of Search ..... 417/454, 360, 413, 38, 417/567, 570, 44, 362, 19, 477; 310/80

[56] References Cited

U.S. PATENT DOCUMENTS

| | | | |
|---|---|---|---|
| 1,176,907 | 3/1916 | Kraft et al. . | |
| 2,253,859 | 8/1941 | Mantle | 417/362 |
| 3,195,170 | 7/1965 | Howard . | |
| 3,415,198 | 12/1968 | Lappo | 417/44 |
| 3,776,666 | 12/1973 | Ludwig | 417/411 |
| 3,825,374 | 7/1974 | Kondo | 417/413 |
| 4,019,837 | 4/1977 | Eull | 417/386 |
| 4,065,969 | 1/1978 | Dinwiddie . | |
| 4,090,404 | 5/1978 | Dupont et al. . | |
| 4,545,735 | 10/1985 | Ims | 417/307 |
| 4,604,539 | 8/1986 | Bertram | 310/80 |

FOREIGN PATENT DOCUMENTS

| | | |
|---|---|---|
| 328806 | 1/1917 | Fed. Rep. of Germany . |
| 1277147 | 9/1968 | Fed. Rep. of Germany . |
| 57-80501 | 5/1982 | Japan . |
| 284679 | 2/1928 | United Kingdom . |

*Primary Examiner*—Richard A. Bertsch
*Assistant Examiner*—Peter Korytnyk
*Attorney, Agent, or Firm*—Hill, Van Santen, Steadman & Simpson

[57] ABSTRACT

An apparatus for conveying paints is connectible via a supply passage to a reservoir and is connectible via a feed passage to an application device. The apparatus includes a diaphragm pump mounted in a closed housing and provided with an admission valve and a discharge valve. The diaphragm pump is driveable with an electric motor that can be switched by a manometric switch dependent on conveying pressure. The admission valve and the discharge valve are commonly arranged in a pump head and are held by a supporting element that is detachably connected to the pump head. Further, the discharge valve is located upsteam of a pressurized chamber that is connected to the feed passage and is also located in the pump head. Variations in feed passage pressure cause variations in the volume of the pressurized chamber by flexing a control diaphragm. The control diaphragm acts on an adjustment element to actuate a control switch. The invention provides an apparatus that is compact, reliable, and easy to manufacture. The apparatus operates at low feed pressures and noise levels. Further, the torque of the drive motor, preferably a split-pole motor, can be easily varied to suit the required conveying power of the diaphragm pump. The invention further permits reproducible adjustment of the manometric switch, and allows quick and easy cleaning of the admission and discharge valves without the need for special tools or disassembly of the housing.

20 Claims, 4 Drawing Sheets

APPARATUS FOR CONVEYING PAINTS

TECHNICAL FIELD

The invention is directed to an apparatus for conveying paints, particularly viscous wall paints, that is connectable at its input end to a reservoir for paint to be applied, and, at its outlet end, to a paint application device.

BACKGROUND OF THE INVENTION

Some previously known paint conveying systems include a diaphragm pump in a closed housing. The diaphragm pump may also include an admission valve and a discharge valve, and be driveable with an asynchronous electric motor that can be switched by a manometric switch dependent on the conveying pressure. The motors in such systems typically use a capacitor, and are arranged in a housing formed of two housing shells joined together. Typically, the housing is laterally provided with two connecting sleeves, arranged parallel to one another, to connect the conveying apparatus to the reservoir and the application device, respectively.

The size and weight of the asynchronous motors used in previously known paint conveying apparatus render such devices large and unwieldy. Since the heft of such conveying apparatus precludes the use of a portable reservoir, painting large areas requires long paint conducting lines to reach a stationary reservoir. Further, it is impossible to optimize the torque output of the asynchronous motor to the input power required by the diaphragm pump, since the motor acts directly on the diaphragm of the pump via a connecting rod. Another major disadvantage is that additional tools are required for cleaning the admission valve and/or the discharge valve in order to be able to screw the valves out of the housing. It is imperative for proper operation of the device that these valves be frequently cleaned, which requires significant time expenditure and results in long operating interruptions. The adjustment of the manometric switch is also complicated, since adjustment requires that both a ram and an adjustment screw, as well as a coil pressure spring, must be set.

SUMMARY OF THE INVENTION

It is therefore an object of the present invention to provide a portable and versatile device for conveying paints that is compact, can be economically manufactured, and that is reliably operable at low feed pressures and noise levels. Additionally, it should be possible to vary the torque of the drive motor to correspond to the optimal conveying power of the diaphragm pump in an extremely simple way, so that a reproducible setting for the manometric switch can be established. The valves should be capable of being installed and removed in a short time without requiring the use of additional tools or disassembly of the device. The pump diaphragm should not have to be changed every time the apparatus is cleaned. Further, flow resistance in the apparatus should be considerably reduced and efficiency enhanced, and the apparatus should be light and compact enough to allow the use of a portable reservoir.

These and other objects are inventively achieved by providing a paint conveying apparatus wherein the admission valve and the discharge valve of the diaphragm pump are arranged in common in a pump head. The pump head includes a diaphragm actuatable by the electric motor. The valves are held by a supporting element that is detachably connected to the pump heads. The discharge valve releases paint to a pressurized chamber that is connected to a feed passage, and both the chamber and the feed passage are located in the pump head. A control diaphragm forms a wall of the chamber, and impinges on an adjustment element of the manometric switch when paint pressure expands the volume of the pressurized chamber.

The supporting element is at least partially fashioned as face wall or partition in a housing, and is releasably connected to the housing with resilient tabs attached to the pump head.

The supporting element includes a supply passage that is in fluid communication with the admission valve and into which is inserted a cylinder. The cylinder surrounds the valve body of the admission valve, acting as a conduit for conveying paint, and is preferably arranged in alignment with the diaphragm pump. The cylinder may also be provided with a lateral projection to support the valve body of the discharge valve via a spring.

In order to reduce flow resistances, a transverse channel in the pump head connects the admission valve to the discharge valve. The cylinder is in fluid-tight contact with the supporting element and the supply passage is connected to a supply line leading to the paint reservoir.

It is also advantageous to secure the pump head to a partition in the housing. The diaphragm of the diaphragm pump and the control diaphragm are coplanar, and are clamped between the pump head and the partition.

The pump head can be mounted in a recess formed in the housing, thus forming a balanced and compact unit.

The supply line from the reservoir or the feed line to the application device can be connected directly to the supporting element. It is also advantageous when the connection for the supply line projects perpendicularly away from the upper surface of the housing. The upper surface of the housing may provide a supporting surface for a reservoir or a seating surface to support the apparatus on a reservoir.

The housing of the apparatus includes two shells whose parting plane lies parallel to the longitudinal axis of the diaphragm pump. The two shells are formed with aligned lugs so that they may be connected to one another with screws or pins. In order to make the apparatus readily portable, the upper surface of the housing shell can be provided with a centrally arranged handle integrally formed opposite the pump head.

The drive motor of the diaphragm pump is preferably a split-pole motor that uses a gear drive to actuate the diaphragm of the diaphragm pump. The rotor of the split-pole motor drives a cam plate via a toothed belt drive or similar drive connection. The stroke of the pump is transmitted to the diaphragm via a connecting rod aligned with the toothed belt drive. A toothed belt sheave of the toothed belt drive, and the cam plate attached thereto, can be rotatably held on a pin secured to the housing The stator of the spilt-pole motor is secured to the housing with an adjustable clamp, thus rendering the motor positionally adjustable in the longitudinal direction of the toothed belt drive.

The motor is actuated by a manometric switch. The switch has a bent lever that is pivotably seated in one of the housing shells. The lever serves as controlling element with one end thereof being actuatable by the control diaphragm and the other end acting on the manometric switch. For setting the switch point of the manometric switch, the lever is pivotable and provided with an eccentric support. The distance between the switch contact and the corresponding end of the bent lever can be varied by selectively rotating the eccentric support, which may be secured with a set screw.

One exemplary apparatus for conveying paints embodying the present invention includes a diaphragm pump with inlet and outlet valves detachably supported in a pump head. The pump head further includes a pressurized chamber arranged downstream of the discharge valve. An increase in discharge pressure causes an expansion of the chamber, and flexes a control diaphragm acting on an adjustment element of a manometric switch. The apparatus is a unit that is compact and reliable, but is also versatile and easily serviceable. The configuration of the pump head, particularly in the region of the diaphragm pump, reduces overall flow resistance. Further, such configuration, in cooperation with the removable supporting element, permits fast and easy cleaning of the valves without the use of additional tools or disassembly of the pump or housing.

The use of a split-pole motor reduces the weight as well as the size of the apparatus, and the torque of the drive motor can be varied to optimize the conveying capacity of the diaphragm pump. A simple, reproducible setting of the switch point can be easily accomplished. With the use of a belt drive system and an adjustable drive motor, the apparatus can be adapted to a variety of potential uses. Since the apparatus of the present invention is comparatively small and light, a reservoir can be directly placed on the housing of the apparatus or, if a larger capacity reservoir is required, the apparatus is light enough to be placed on a paint container. Thus, the paint to be applied can be directly supplied to the diaphragm pump from a supply source, and the entire paint application system can be used, cleaned, and transported with a minimal expenditure of time and effort.

Other objects and advantages of the present invention will become apparent upon reference to the accompanying description when taken in conjunction with the following drawings.

DETAILED DESCRIPTION OF THE PREFERRED EMBODIMENT

Figure 1:
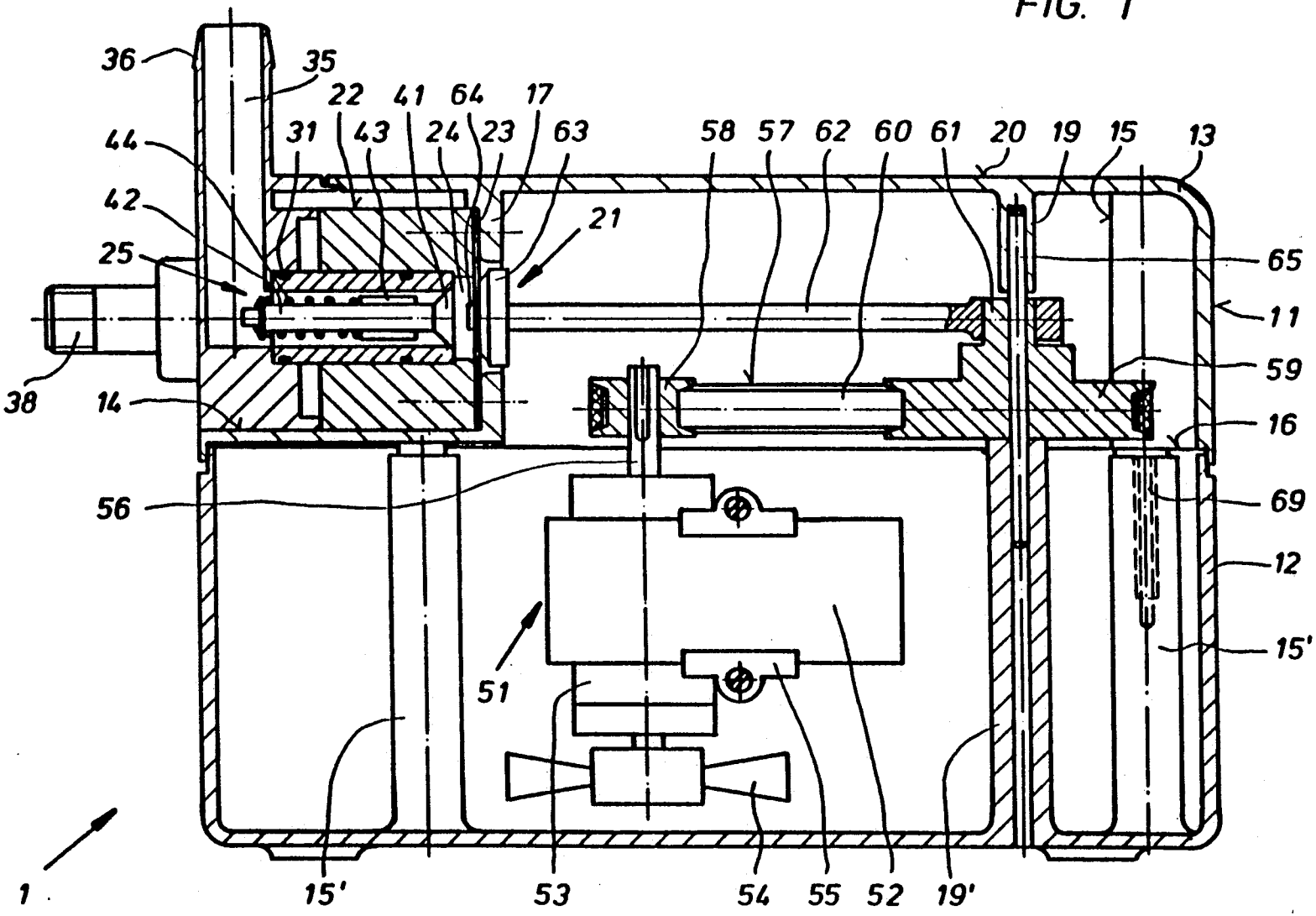
FIG. 1 is a sectional view of a paint conveying apparatus embodying the present invention.
Figure 2:
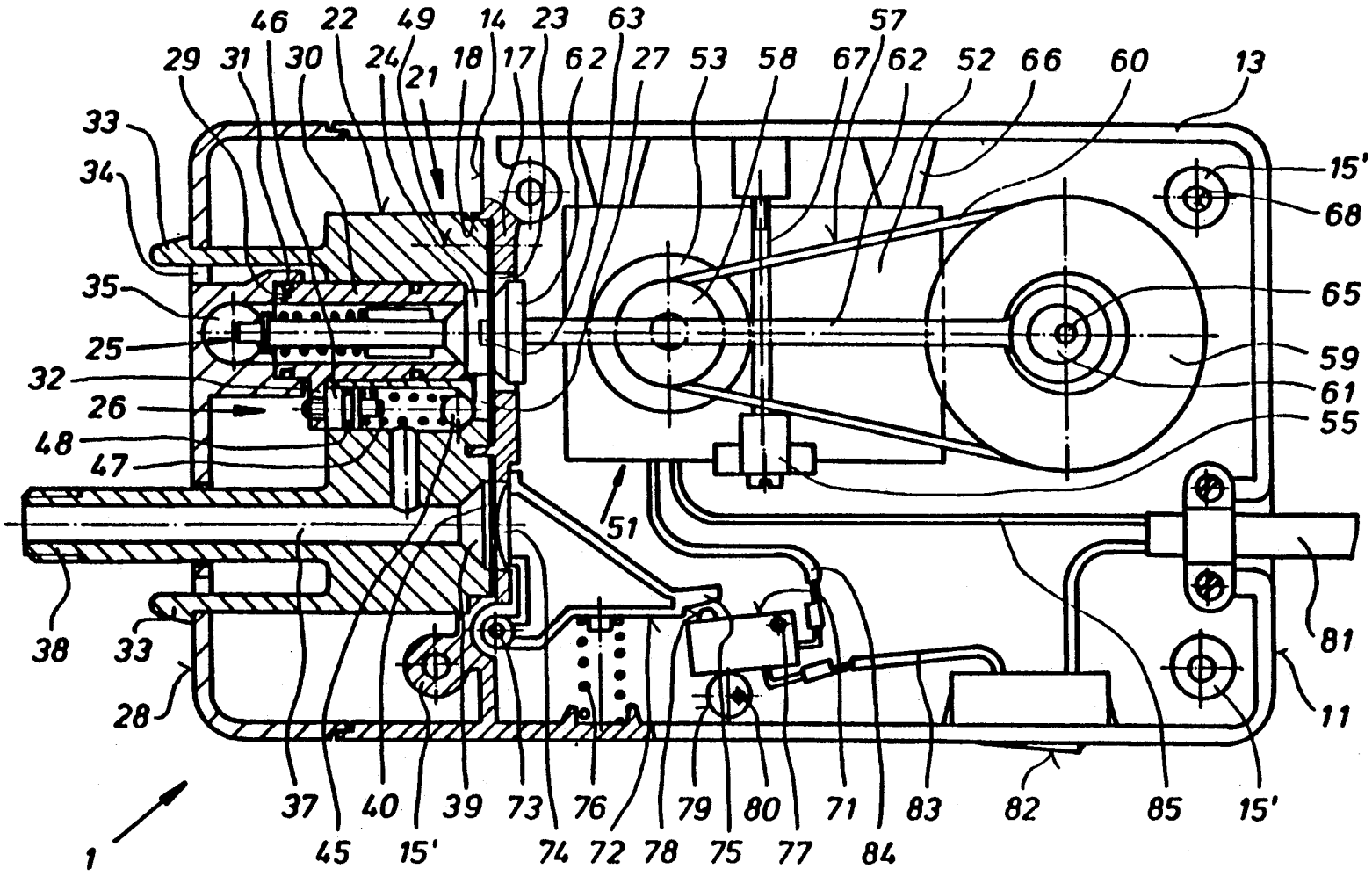
FIG. 2 is a sectional view of the apparatus of FIG. 1 taken generally along lines II—II.

The apparatus shown in FIGS. 1 and 2 and referenced 1 conveys paint or a similar medium from a reservoir (not shown) to an application unit (not shown), for example a paint roller, a paint pad, a brush or the like. The apparatus includes a diaphragm pump 21 that can be driven with a drive motor 51, all of which is inserted in a housing 11.

In the FIG. 1 embodiment, the diaphragm pump 21 includes a diaphragm 23 clamped at its periphery between a pump head 22 and a partition 17. The pump head 22 is centered in a recess 14 of the housing 11 by a centering ridge 18, and is firmly connected to the partition 17 with screws 49. Further, the center of diaphragm 23 is clamped between two plates 63 and 64 which are rigidly secured to a connecting rod 62. The connecting rod 62 is driven by a drive motor 51 via a drive assembly to be described hereinafter.

Valves 25 and 26 associated with the diaphragm pump 21 are built into the pump head 22. Paint enters the pump chamber 24 through the admission valve 25, and exits the pump chamber 24 through the discharge valve 26 the discharge valve 26 is directly connected to the admission valve 25 via a transverse channel 27. The admission valve 25 is arranged in alignment with the connecting rod 62 and is directly connected to a supply passage 35 to minimize flow losses that occur when paint travels through long and tortuous passages.

The admission valve 25 includes a valve rod 42 attached to a valve body 41 and inserted in a cylinder 30. A valve spring 44 coaxially surrounds the valve rod 42 and is supported by ribs 43. The ribs 43 provide a clearance between the valve rod 42 and the cylinder 30, thus permitting the flow of paint therebetween. The discharge valve 26 includes a ball valve 45 and is biased closed by a valve spring 47. The valve spring 47 abuts a spring stop 46 that is inserted into a bore and sealed therein by an O-ring 48. The spring stop is secured by a projection 32 that extends laterally from the cylinder 30.

The parts of the admission valve 25 and of the discharge valve 26 are commonly held by a supporting element 28 that is detachably connected to the pump head 22. The supporting element 28 includes a bore 29 for the cylinder 30 housing the admission valve 25. An O-ring 31 provides a fluid-tight seal between the element 28 and the cylinder 30. Resilient tabs 33 selectively engage recesses 34 to releasably secure the supporting element 28 to the pump head 22.

When the resilient tabs 33 are inwardly deformed, the supporting element 28 can be easily removed from the pump head 22. When the supporting element 28 is removed, the cylinder 30 is easily accessible and can be removed from the pump head 22, so that all component parts of the admission valve 25 and of the discharge valve 26 can be easily cleaned or replaced without the use of special tools, and without disassembly of the housing 11 of the apparatus 1.

Further, a feed passage 37 leading away from the discharge valve 26 is formed in the pump head 22 and has, at its outer end, a connecting sleeve 38 for a connecting hose from the apparatus 1 to an application device. The supply passage 35 that directly discharges into the cylinder 30 of the admission valve 25, is formed in the supporting element 28, and has a connecting sleeve 36 at its outer end. Moreover, the connecting sleeve 36 projects perpendicularly to the upper surface 20 of the housing 11. The upper surface 20 can be used as a supporting surface, so that the connecting sleeve 36 can be directly introduced into a paint reservoir that can be put in place as an upper container. Of course, the apparatus 1 can also be configured so that its components are vertically pivoted by 180° to the illustrated embodiment, and would thus be mounted on top of the paint reservoir.

The pump head 22 further comprises a pressurized chamber 39 downstream of the discharge valve 26. The pressure in the pressurized chamber 39 flexes a control diaphragm 40 that is coplanar with the diaphragm 23. When pressure in the chamber 39 reaches a predetermined level, the control diaphragm 40 expands far enough to impinge a controlling element 72 of a manometric switch 71 to actuate the drive motor 51.

In a preferred embodiment, the drive motor 51 is a split-pole motor that acts on the connecting rod 62 via a toothed belt drive 57. A toothed belt sheave 58 is attached (in an "anti-twist" fashion) to the drive shaft 56 of the split-pole motor 51. Another toothed belt sheave 59, in a drive connection with the toothed belt sheave 58 via a toothed belt 60, is rotatably seated on a pin 65 held in the housing 11. The toothed belt 59 is provided with a cam plate 61 that is secured to the connecting rod 62. The rotary motion of the drive shaft 56 of the split-pole motor 51 is converted into oscillatory motion of the connecting rod 62 by the cam plate 61. As soon as the split-pole motor 51 is switched on, the diaphragm 23, which is rigidly connected to the rod 62, executes a reciprocating motion. An intake stroke creates suction to draw paint out of a reservoir and into the pump chamber 24, and a pressure stroke forces paint from the chamber 24, to be conveyed via the pressure line 37 to a paint application device.

The split-pole motor 51 is composed of a stator 52 and a rotor 53, and is provided with a cooling fan 54. The position of the motor 51 is adjustable with respect to the belt drive 57 and the connecting rod 62. Clamps 55 press the stator 52 against bearings 66 by means of adjusting rods 67. Thus, if it becomes necessary to vary the transmission ratio of the toothed belt drive 57 by replacing one or both of the toothed belt sheaves 58, 59, the toothed belt drive 57 can nonetheless be easily retightened.

The housing 11 of the apparatus 1 is composed of two shells 12 and 13 whose parting plane 16 lies parallel to the axis of the connecting rod 62. The two shells 12 and 13 are firmly secured to one another with screws 69 that pass through lugs 15 integrally formed in the shell 12. The screws 69 extend into threaded bores 6B of the corresponding lugs 15' formed in the shell 13. The pin 65 carrying the toothed belt sheave 59 and the cam plate 61 is likewise inserted into similar lugs 19, 19'.

The controlling element 72 acting on the manometric switch 71 is formed as a bent lever and is mounted in the shell 13 to pivot about a pin 73. One end 74 of the adjustment element 72 presses against the control diaphragm 40 due to the biasing force of a spring 76; the other end 75 of the adjusting element acts on a switch contact 78 of the manometric switch 71. When the pressure in the pressurized chamber 39 rises, the control diaphragm 40 becomes more and more outwardly distended, and causes the controlling element 72 to pivot. When the chamber 39 reaches a predetermined pressure, the switch contact 78 is actuated by the end 75 of the controlling element 72 and the power supply to the split-pole motor 51 is interrupted. Otherwise, when the main switch 82 is switched on, the apparatus is connected to a power main via a current conductor 81 and leads 83, 84 and 85. The manometric switch can thus be actuated to limit the conveying pressure of the diaphragm pump 21.

In order to be able to easily set the maximum conveying pressure, the manometric switch 71 pivots about a pin 77, and its position can be reproducibly set with an eccentric support 79 seated on a pin 80. When the eccentric support 79 is rotated, the distance between the switch contact 78 of the manometric switch 71 and the end 75 of the controlling element 72 can be set and, thus, the switch point of the split-pole motor 51 can be varied.

Figure 3:
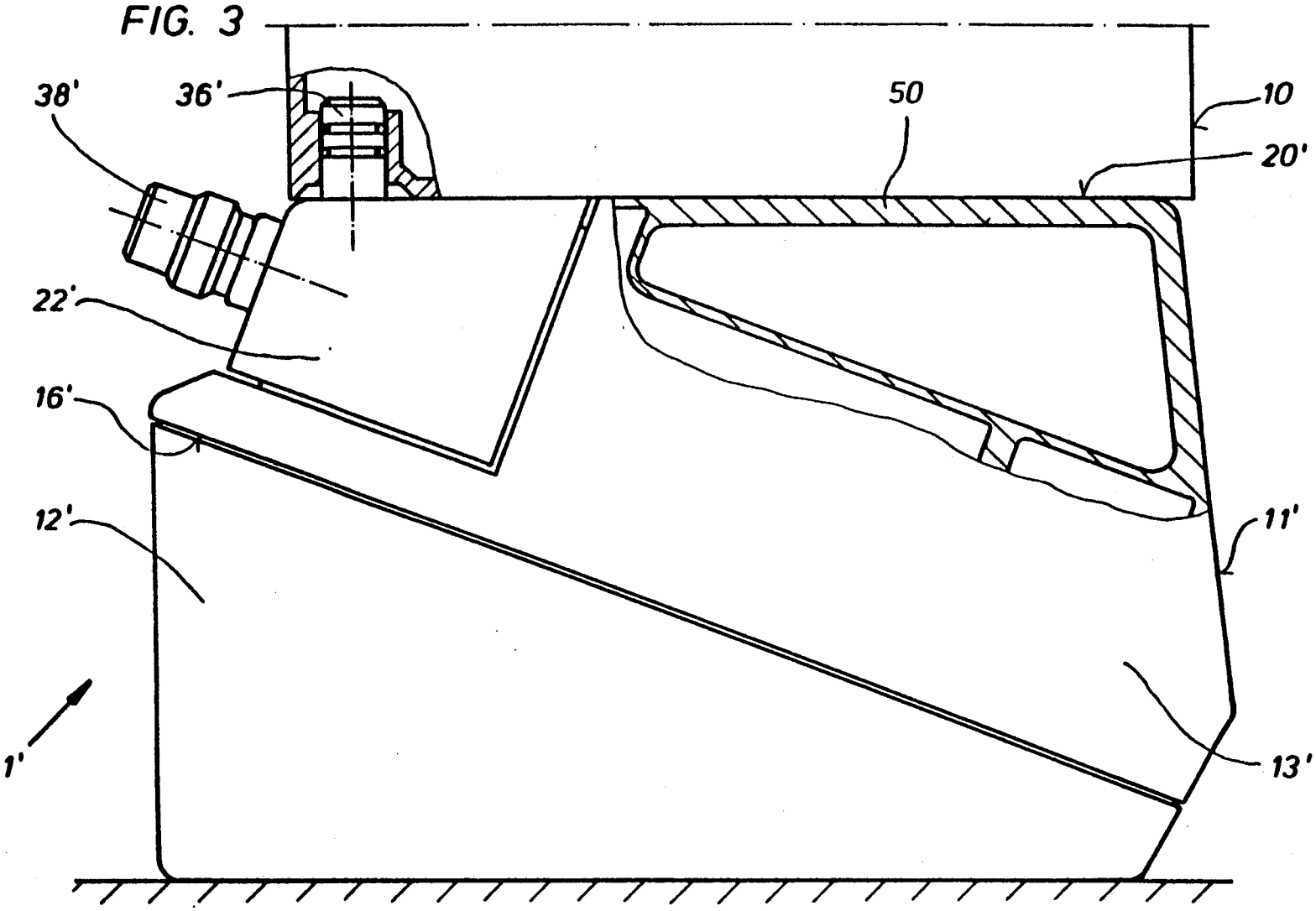
FIG. 3 is a side elevational view partially cut away of a second embodiment of the invention.
Figure 4:
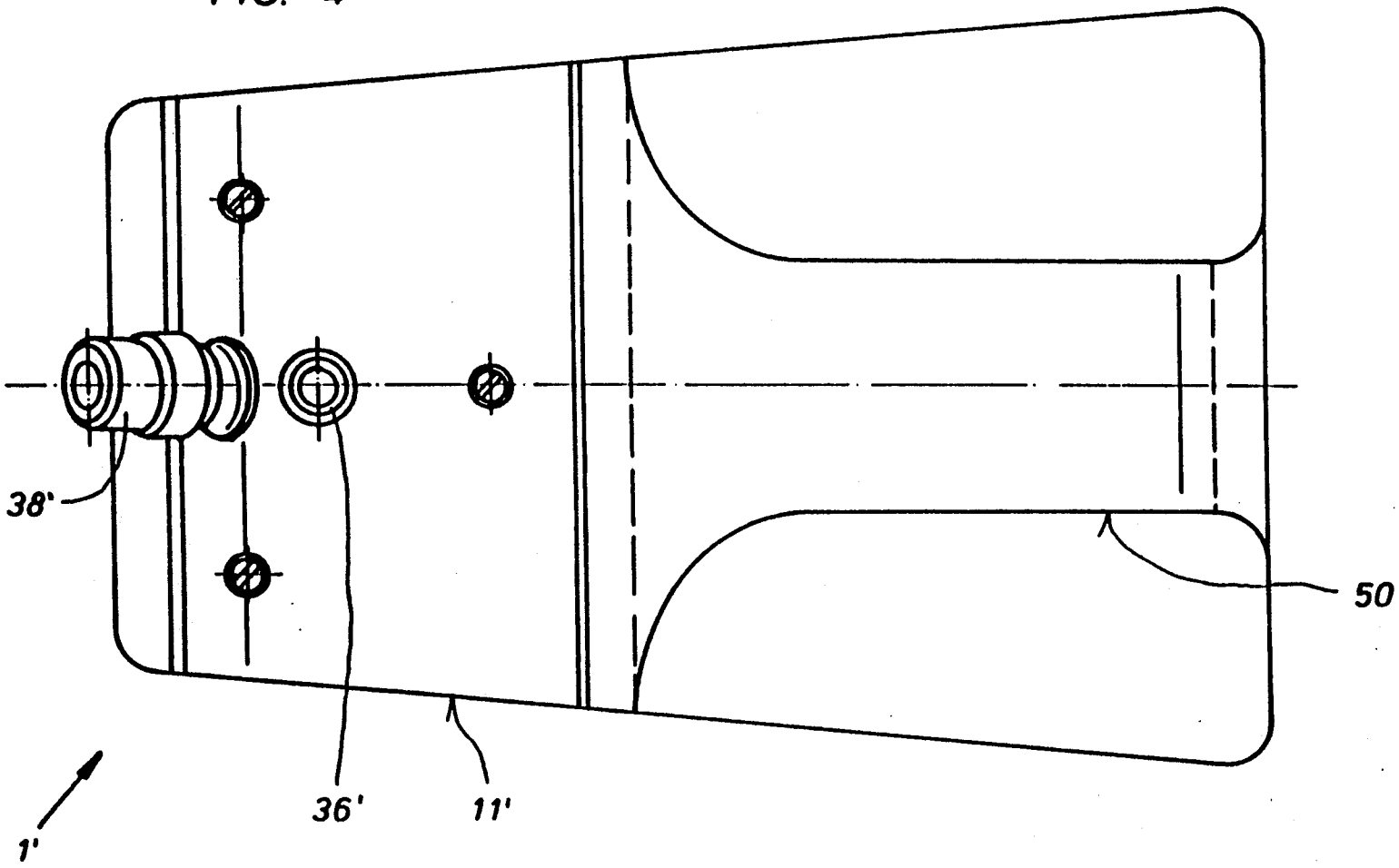
FIG. 4 is a plan view of the apparatus of FIG. 3.

In the apparatus 1' of FIGS. 3 and 4, a handle 50 is integrally formed in the shell 13' of the housing 11'. The handle 50 is centrally located at the side of the housing opposite the pump 22'. The parting plane 16' of the two shells 12' and 13' in fact lies at an angle, but is still parallel to the longitudinal axis of the diaphragm pump and to the connecting sleeve 38' of the feed passage. The connecting sleeve 36' of the supply passage, is perpendicular to the upper surface 20' of the shell 13', so that the sleeve 36' can project directly into the reservoir 10.

Although the present invention has been described with reference to specific embodiments, those of skill in the art will recognize that changes may be made thereto without departing from the scope and spirit of the invention as set forth in the appended claims.

We claim as our invention:

1. An apparatus for conveying fluid material, said apparatus comprising the following:

a diaphragm pump enclosed in a housing, said diaphragm pump including a diaphragm, an admission valve receiving paint from a reservoir via a supply passage, and a discharge valve leading to a fluid material application device via a feed passage;

an electric motor means for selectively actuating said diaphragm, thereby driving said pump;

a pump head including, as parts thereof, said diaphragm and said admission and discharge valves;

a supporting element detachably securing said admission and discharge valves to said pump head;

a chamber provided in said pump head in fluid communication with said feed passage and having a wall comprising a control diaphragm that is distendably responsive to pressure variations in said feed passage; and a manometric switch means for controlling said motor means, said switch means comprising a controlling element means responsive to said control diaphragm, for actuating said switch means; and wherein said supporting element is at least partially formed as a partition in said housing and is detachably connected to said housing by resilient tabs integrally formed with said pump head.

2. An apparatus according to claim 1, further wherein said supporting element comprises the following:

a bore opening toward said admission valve;

a cylinder coaxially surrounding a valve body of said admission valve and insertable into said bore; and wherein said cylinder provides a conduit for fluid material conducted through said admission valve.

3. An apparatus according to claim 2, further wherein said cylinder of said supporting element comprises a lateral projection means for resiliently supporting a valve body of the discharge valve.

4. An apparatus according to claim 3, further wherein said admission valve is connected to said discharge valve via a transverse channel integrally formed in said pump head.

5. An apparatus according to claim 4, further wherein said bore of said supporting element is in fluid communication with said supply passage, and a fluid-tight seal is provided between said cylinder and said supporting element.

6. An apparatus according to claim 1, further wherein said pump head abuts a wall of the housing, and said diaphragm of the diaphragm pump and said control diaphragm are coplanar and are clamped between the pump head and said wall.

7. An apparatus according to claim 6, further wherein said pump head is inserted in a concave recess in the housing, and said pump head and said supporting element conform to the shape of said recess.

8. An apparatus according to claim 1, further comprising the following:

a first connecting sleeve associated with said supply passage;

a second connecting sleeve associated with said feed passage; and wherein said first connecting sleeve is integrally formed with said supporting element and said second connecting sleeve is integrally formed with said pump head.

9. An apparatus according to claim 8, further wherein the first connecting sleeve projects from the housing perpendicularly relative to an upper surface of said housing, and wherein said upper surface of the housing provides a supporting surface for a reservoir.

10. An apparatus according to claim 1, further wherein said housing includes two shells, a parting plane of which lies parallel to a longitudinal axis of the diaphragm pump, said two shells being connectable to one another with fasteners introducible into lugs integrally formed in said respective shells.

11. An apparatus according to claim 10, further wherein one of said shells comprises an upper housing shell that is provided with an integrally formed centrally arranged handle lying opposite the pump head.

12. An apparatus according to claim 1, further wherein said electric motor means comprises a spilt-pole motor in drive connection with the diaphragm of the diaphragm pump via gearing means.

13. An apparatus according to claim 12, further wherein said split-pole motor comprises a rotor that is in drive connection with a cam plate via a toothed belt drive, whereby the stroke of said split-pole motor is capable of being transmitted onto the diaphragm of said diaphragm pump via a connecting rod aligned with said toothed belt drive.

14. An apparatus according to claim 13, further wherein said belt drive comprises a toothed belt sheave that, together with said cam plate, is rotatably mounted on a pin secured in lugs integrally formed in said housing.

15. An apparatus according to claim 13, further wherein said split-pole motor further comprises a stator, and said housing further comprises clamp means for adjustably securing said stator with respect to said toothed belt drive.

16. An apparatus according to claim 12, further wherein said adjustment element means comprises a bent lever pivotably seated in said housing, wherein a first end of said bent lever is spring-biased against said control diaphragm, and a second end of said bent lever selectively impinges on said manometric switch.

17. An apparatus for conveying fluid material, said apparatus comprising the following:

a diaphragm pump enclosed in a housing, said diaphragm pump including a diaphragm, an admission valve receiving paint from a reservoir via a supply passage, and a discharge valve leading to a fluid material application device via a feed passage;

an electric motor means for selectively actuating said diaphragm, thereby driving said pump;

a pump head including, as parts thereof, said diaphragm and said admission and discharge valves;

a supporting element detachably securing said admission and discharge valves to said pump head;

a chamber provided in said pump head in fluid communication with said feed passage and having a wall comprising a control diaphragm that is distendably responsive to pressure variations in said feed passage; and a manometric switch means for controlling said motor means, said switch means comprising a controlling element means responsive to said control diaphragm, for actuating said switch means;

said controlling element means comprising a bent lever pivotably seated in said housing, wherein a first end of said bent lever is spring-biased against said control diaphragm, and a second end of said bent lever selectively impinging on said manometric switch; and means for setting the switch point of the manometric switch by eccentrically pivotably suspending said switch and varying the distance between a contact of said switch and said second end of the bent lever.

18. An apparatus according to claim 17, further wherein said electric motor means comprises a split-pole motor in drive connection with the diaphragm of the diaphragm pump via gearing means.

19. An apparatus according to claim 1, further wherein said supporting element comprises the following:

a bore opening towards said admission valve;

a cylinder coaxially surrounding a valve body of said admission valve and insertable into said bore; and wherein said cylinder provides a conduit for fluid material conducted through said admission valve.

20. An apparatus for conveying fluid material, said apparatus comprising the following:

a pump housing;

a pump head including a diaphragm, an admission valve receiving fluid material from a fluid material reservoir via a supply passage, a discharge valve leading to a fluid material discharge outlet via a feed passage, a chamber in communication with said feed passage downstream of said discharge valve and having a wall comprising a control diaphragm, and a pair of resilient tabs; and a supporting element at least partially formed as a partition in said pump housing, said supporting element being engageable with said resilient tabs or said pump head to secure said pump head to said pump housing.

* * * * *